United States Patent [19]

Semplak

[11] 4,231,043

[45] Oct. 28, 1980

[54] TECHNIQUE FOR REDUCING NEAR-IN SIDELOBES OF AN OFFSET ANTENNA

[75] Inventor: Ralph A. Semplak, Shrewsbury, N.J.

[73] Assignee: Bell Telephone Laboratories, Incorporated, Murray Hill, N.J.

[21] Appl. No.: 68,731

[22] Filed: Aug. 22, 1979

[51] Int. Cl.[3] ..... H01Q 13/02; H01Q 19/13

[52] U.S. Cl. ..... 343/786; 343/840

[58] Field of Search ..... 343/781 R, 782, 783, 343/786, 840, 909

[56] References Cited

U.S. PATENT DOCUMENTS

| | | | |
|---|---|---|---|
| 2,597,313 | 6/1945 | Gardner | 343/840 |
| 3,101,473 | 8/1963 | Fenlon | 343/760 |
| 3,156,917 | 11/1964 | Parmeggiani | 343/782 |
| 3,314,071 | 4/1967 | Lader et al. | 343/912 |
| 3,995,274 | 11/1976 | Schwartz et al. | 343/783 |

OTHER PUBLICATIONS

Peters et al.; IEEE Trans. EMC-6, No. 1, Jan. 1964, RFI Reduction by Control of Antenna Sidelobes, pp. 1–11.

Yokol, et al.; Low-Sidelobe Paraboloidal Antenna with Microwave Absorber, Elec. & Comm. in Japan, vol. 54–B, No. 11, pp. 34–39.

Hamid et al.; Radiation Characteristics of Dielectric-Loaded Horn Antennas, Electronic Letters, vol. 6, No. 1, Jan. 8, 1970, pp. 20–21.

Ashton et al.; Rectangular Horn with Dielectric-Slab Insert; Electronic Letters, vol. 9, No. 2, Jan. 25, 1973, pp. 26, 27.

*Primary Examiner*—Eli Lieberman

*Attorney, Agent, or Firm*—Erwin W. Pfeifle

[57] ABSTRACT

The present invention relates to technique for reducing near-in sidelobes of an offset antenna. The method comprises positioning at least one piece of microwave absorbing material on a sector of the edge of the reflecting surface of the offset main reflector closest to the focal point of the antenna. The material is positioned on the portion of the edge of the reflecting surface nearest the focal point of the main reflector in such a manner as to achieve substantial selective reduction of the near-in sidelobes generated by the antenna.

5 Claims, 8 Drawing Figures

TECHNIQUE FOR REDUCING NEAR-IN SIDELOBES OF AN OFFSET ANTENNA

BACKGROUND OF THE INVENTION

1. Technical Field

This invention relates to a technique for reducing near-in sidelobes of an offset antenna, and more particularly, to a technique for reducing near-in sidelobes of an offset antenna which uses at least one piece of microwave absorbing material attached to the reflecting surface of the main reflector of the offset antenna, each piece bordering on a portion of the sector of the edge of the main reflector nearest the focal point of the main reflector.

2. Description of the Prior Art

Demands have been made in recent years to improve an antenna's sidelobe performance, since these sidelobes limit the number of converging routes of a common carrier microwave system. Far sidelobe reduction, for those sidelobes more than 35 degrees off the main beam, has been achieved for the horn reflector antenna by adding blinders (extensions to the sidewalls of the horn) to the aperture area of the antenna. While reducing the far sidelobes, this method does not improve the near-in sidelobe performance, where the most severe interference occurs.

Various methods have been tried to improve the near-in sidelobe performance, usually by coating the rim of the reflector with absorbing material. One example of such a method is disclosed in U.S. Pat. No. 3,314,071 issued to L. J. Lader et al on July 12, 1965. There, a tapered ring of absorbing material is attached to the periphery of the reflector. A reduction of the near-in sidelobes is achieved by the use of the tapered ring, but the phase error of the system is increased thereby, and the overall beamwidth must be increased to compensate for the increased phase error. Many of the attempts at sidelobe reduction using a peripheral ring of absorbing material suffer the same problems of increased phase error and the need for increased beamwidth.

Another approach, used with the horn reflector antenna, involves altering the horn to improve sidelobe performance. Like the sidelobe reduction methods described hereinabove involving the reflector, the horn is altered by additions of absorbing material. For example, it is known that a coating of absorbing material placed on the sidewalls of the horn is found to reduce the far sidelobes, but does not improve near-in sidelobe performance. An article in *Electronics Letters,* Vol. 9, No. 2, p. 26–27 by R. Ashton and R. Baldwin discusses a method of near-in sidelobe reduction using a dielectric slab placed across the aperture of a rectangular horn in the H field direction. The reduction is achieved, but at the expense of attenuation of the main beam of the radiation pattern due to the properties of the dielectric.

The problem remaining in the prior art is to provide a technique which permits selective reduction of near-in sidelobes with a minimal amount of attenuation of the main beam and increase in beamwidth.

SUMMARY OF THE INVENTION

The problem remaining in the prior art has been solved in accordance with the present invention, which relates to a technique for reducing near-in sidelobes of an offset antenna, and more particularly, to a technique for reducing near-in sidelobes of an offset antenna which uses at least one piece of microwave absorbing material attached to the reflecting surface of the main reflector of the offset antenna, each piece bordering on a portion of the sector of the edge of the reflecting surface nearest the focal point of the main reflector.

It is an aspect of this invention to provide positioning and arrangements of one or more pieces of microwave absorbing material on the portion of the reflector surface closest to the focal point to influence the resulting sidelobe reduction. Moreover, these pieces are not required to be rectangular-shaped, but may be wedge-shaped, have rounded edges, or be of any suitable shape. The radiation pattern of the reflected wavefront will be altered depending on the shape of the material used, since the number of edges of absorbing material the wavefront encounters influences the resulting radiation pattern.

It is another aspect of the present invention to place at least one piece of absorbing material asymmetrically on the reflecting surface to selectively reduce only those sidelobes that are of concern. Alternatively, symmetric placement of absorbing material on the edge of the reflecting surface nearest the focal point of the main reflector will cause like reduction of the sidelobes on both sides of the main beam.

Other and further aspects of the present invention will become apparent during the course of the following description and by reference to the accompanying drawings.

BRIEF DESCRIPTION OF THE DRAWINGS

Referring now to the drawings, in which like numerals represent like parts in several views.

DETAILED DESCRIPTION

A rectangular horn-reflector antenna is used in the description which follows and the accompanying drawings for illustrative purposes only. It will be understood that such description is exemplary only and is for purposes of exposition and not for purposes of limitation since the present invention is applicable to any type of offset antenna arrangement.

Figure 1:
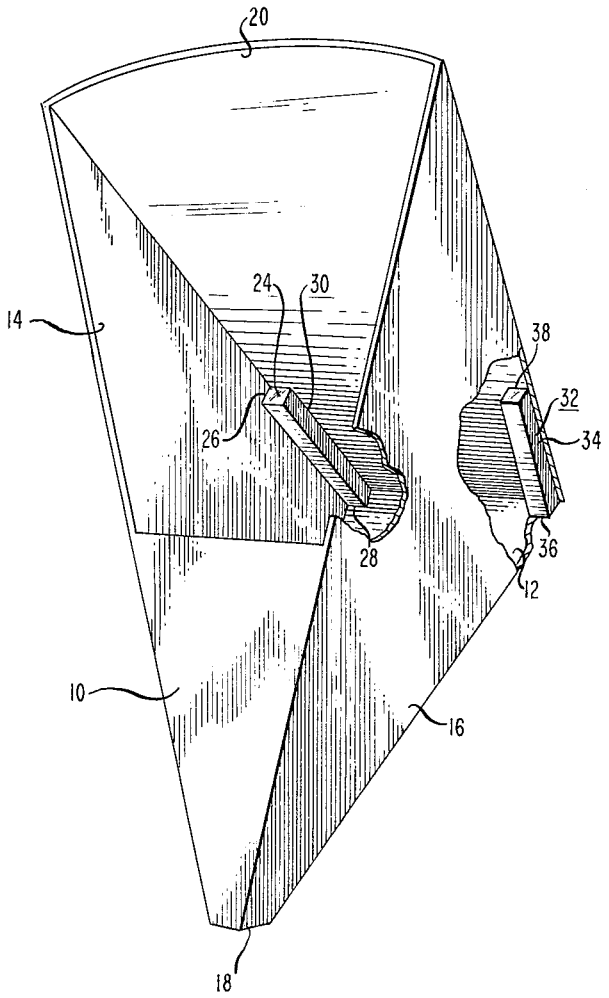
FIG. 1 is a cut-away in perspective of a rectangular horn-reflector antenna showing the placement of strips of microwave absorbing material in the rear corners of the reflecting surface, nearest the apex of the horn in accordance with the present invention.

In FIG. 1, an exemplary horn-reflector antenna is shown, with a portion of the horn removed to show clearly one arrangement of positioning pieces of absorbing material on the reflecting surface in accordance with the present invention. The rectangular horn comprises a front 10, a back 12 and two sides 14 and 16. The apex point 18 in FIG. 1 is generally located on the longitudinal axis of the horn intermediate the ends of wave-guide transformer. The side members 14 and 16 serve to join the corresponding edges of the front and back sides 10 and 12, and side members 14 and 16 extend upwardly beyond the upper ends of the front and back sides 10 and 12, to join the lateral edges, respectively, of an offset paraboloidally shaped reflector 20. The focal point of the paraboloidal reflector 20 is coincident with the common apex point 18 of front 10 and back 12. A rectangular piece of absorbing material 24 comprising sides 26, 28 and 30 is formed to fit in the corner formed by back 12, side 14 and paraboloidal reflector 20 such that side 26 of piece 24 is adjacent to side 14, side 28 of piece 24 is adjacent to back 12 and side 30 of piece 24 is adjacent to reflector 20. The absorbing material may be any suitable absorbing material, one example of which is Eccosorb ®AN-72, a product of Emerson and Cuming, Inc. In a like manner, a rectangular piece of absorbing material 32 comprising sides 34, 36 and 38 is formed to fit and is positioned in the corner formed by back 12, side 16 and paraboloidal reflector 20 such that side 34 is adjacent to side 16, side 36 is adjacent to back 12 and side 38 is adjacent to reflector 20.

Figure 2:
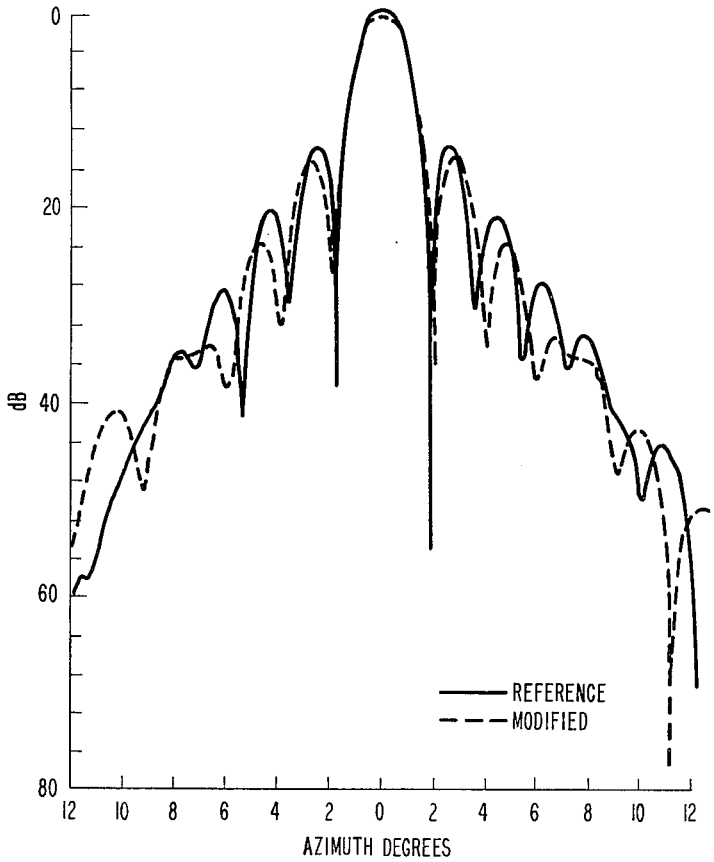
FIG. 2 illustrates the radiation patterns for a transverse polarization of the antenna configuration of FIG. 1 where the dashed curve represents the radiation pattern for the modified antenna of FIG. 1 and the solid curve represents the radiation pattern for the antenna without the strips of absorbing material shown in FIG. 1.

FIG. 2 provides a comparison of the radiation patterns for a transverse polarization of the antenna configuration of FIG. 1 where the dashed curves represents the radiation pattern for the modified antenna shown in FIG. 1 comprising pieces 24 and 32 of absorbing material and the solid curve represents the radiation pattern for the antenna of FIG. 1 without the pieces 24 and 32 of absorbing material. From the curves shown in FIG. 2, it can be seen that by placement of pieces 24 and 32 as shown in FIG. 1, (1) the loss in gain in the main beam of the modified antenna shown by the dashed curve is only approximately 0.3 dB, (2) the shape of the main beam is maintained, and (3) the sidelobes within 10 degrees of the main beam are reduced.

Figure 3:
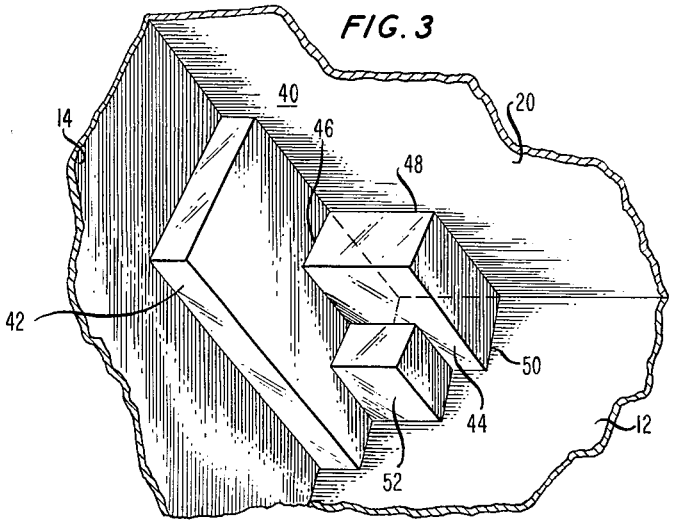
FIG. 3 is a cut-away view of a section of a horn-reflector antenna similar to FIG. 1 showing an alternative arrangement of strips of microwave absorbing material at a lower corner of the reflecting surface of FIG. 1.

FIG. 3 represents a variant of FIG. 1 where the absorbing material of FIG. 1 is replaced by an absorbing material arrangement 40 as shown in FIG. 3 comprising three pieces 42, 44 and 52 where piece 42 of arrangement 40 corresponds to the piece of absorbing material 24 of FIG. 1 in size, shape and placement. Piece 44 of absorbing material arrangement 40 comprises a rectangular piece of smaller size than piece 42, piece 44 comprising sides 46, 48 and 50 positioned in such a manner that side 46 is adjacent to piece 42 and side 48 is adjacent to paraboloidal reflector 20 and side 50 is adjacent to back 12. Piece 52 of absorbing material arrangement 40 comprises a rectangular piece of smaller size than piece 44, positioned in such a manner that separate sides of piece 52 are adjacent to both pieces 42 and 44, and back 12.

Figure 4:
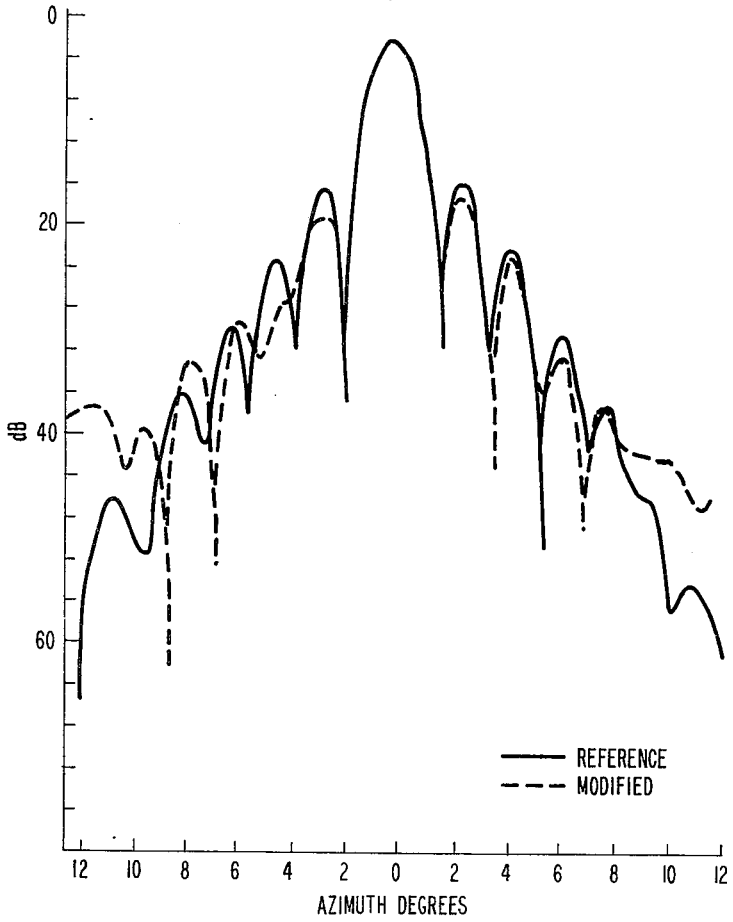
FIG. 4 illustrates the radiation patterns for a transverse polarization of the antenna configuration of FIG. 3 where the dashed curve represents the radiation pattern for the modified antenna shown in FIG. 3 and the solid curve represents the radiation pattern for the antenna without the strips of absorbing material shown in FIG. 3.

FIG. 4 provides a comparison of the radiation patterns for a transverse polarization of the antenna configuration of FIG. 3 where the dashed curve represents the radiation pattern for the modified antenna shown in FIG. 3 comprising absorbing material arrangement 40 and the solid curve represents the radiation pattern for the antenna of FIG. 3 without arrangement 40 of absorbing material. From the curves shown in FIG. 4, it can be seen that by the placement of arrangement 40 as shown in FIG. 3 there is a slight distortion in the radiation pattern on the side of the antenna that contained no absorbing material, due to the change in the overall electric field distribution on reflector 20 of FIG. 3. However, the shape of the radiation pattern for the side of the antenna in FIG. 3 without absorbing material arrangement 40 remains fairly similar to the shape of the radiation pattern for an antenna as in FIG. 3 without absorbing material arrangement 40. On the side of the antenna where absorbing material arrangement 40 is positioned, the attenuation of the near-in sidelobes is greater than that for an antenna without absorbing material arrangement 40, as shown in FIG. 4. The first sidelobe is reduced by approximately 3-dB and the second sidelobe is reduced by approximately 4.5-dB. The symmetry in the radiation pattern of the antenna without absorbing material arrangement 40 is not preserved in the radiation pattern for the antenna as shown in FIG. 3, due to the fact that the absorbing material is positioned in only one corner of the reflecting surface.

Figure 5:
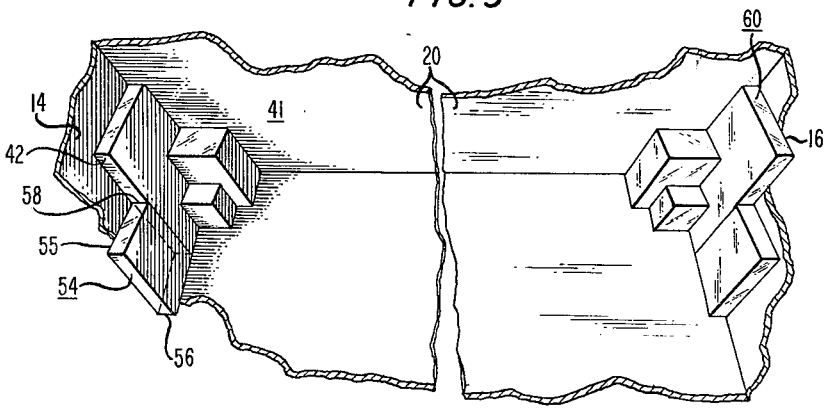
FIG. 5 is a cut-away in perspective of a section of a rectangular horn-reflector antenna similar to FIG. 1 showing another alternative arrangement of strips of absorbing material in the lower rear corners of the reflecting surface of FIG. 1.

FIG. 5 represents a variant of FIG. 3 where a piece of absorbing material 54 is added to absorbing material arrangement 40 of FIG. 3 to form a new arrangement 41. Absorbing material 54 comprises sides 55, 56 and 58, and is positioned in a manner such that side 55 is adjacent to horn side 14, side 56 is adjacent to horn back 12 and side 58 is adjacent to absorbing material 42. In a like manner, an absorbing material arrangement 60, having a configuration similar to arrangement 41 but in a reverse manner, is placed in the corner formed by sides 12, 16 and reflector 20 to obtain symmetry across the lower half of the reflecting of the reflector in the absorbing material arrangement.

Figure 6:
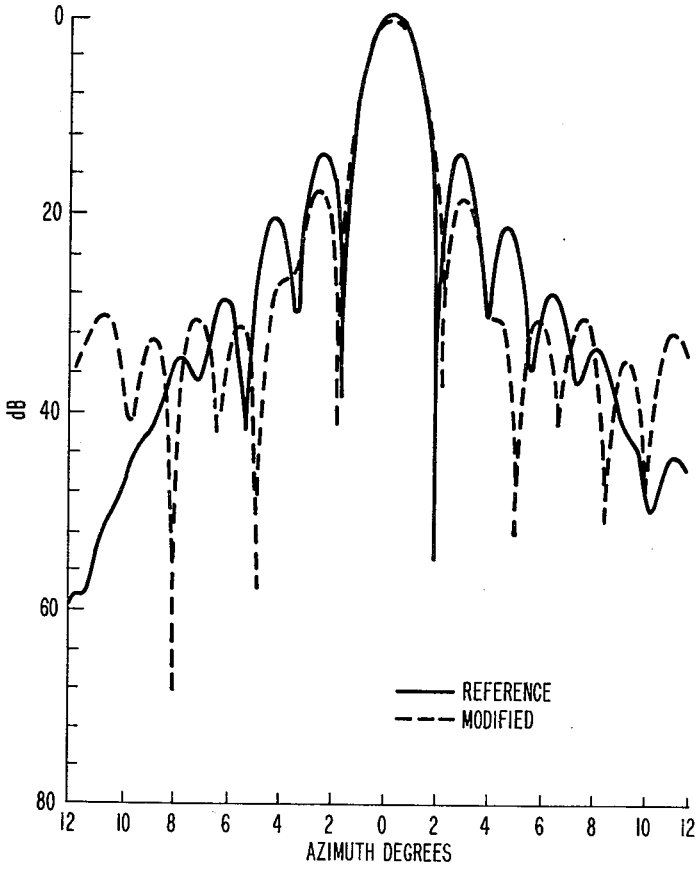
FIG. 6 illustrates the radiation patterns for a transverse polarization of the antenna configuration of FIG. 5 where the dashed curve represents the radiation pattern for the modified antenna of FIG. 5 and the solid curve represents the radiation pattern for the antenna without the strips of absorbing material shown in FIG. 5.

FIG. 6 provides a comparison of the radiation patterns for a transverse polarization of the antenna configuration of FIG. 5 where the dashed curve represents the radiation pattern for the modified antenna shown in FIG. 5 comprising absorbing material arrangements 41 and 60 and the solid curve represents the radiation pattern for the antenna of FIG. 5 without absorbing material arrangements 41 and 60. From the curves shown in FIG. 6, it can be seen that by placement of arrangements 40, 54 and 60 there is a loss in gain for the main beam of only approximately 0.5-dB, with no noticeable change in the shape of the beam itself. For the antenna modified by arrangements 41 and 60 as shown in FIG. 5, the first sidelobes are reduced by approximately 4-dB, the second sidelobes by approximately 10-dB and the third sidelobes by approximately 2-dB. It is to be noted that there is an increase in the outer sidelobe levels for the antenna configuration of FIG. 5, due to the scattering effect of the absorbing material edges. The symmetry in the radiation pattern of the antenna configuration shown in FIG. 5 is obtained by placing the absorbing material in both lower rear corners of the reflector nearest the apex 18 of the horn.

Figure 7:
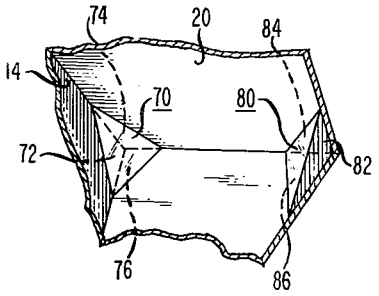
FIG. 7 is a cut-away in perspective of a section of a rectangular horn-reflector antenna similar to FIG. 1 showing the placement of triangular wedges of absorbing material in the lower rear corners of the reflecting surface of FIG. 1.

FIG. 7 is a variant of FIG. 1 where absorbing material 24 is replaced by a wedge-shaped piece 70 of absorbing material comprising sides 72, 74, 76 positioned in such a manner that side 72 is adjacent to horn side 14, side 74 is adjacent to reflector 20, and side 76 is adjacent to horn back 12. In a like manner, absorbing material 32 of FIG. 1 is replaced by a wedge-shaped piece 80 of absorbing material comprising sides 82, 84, 86 positioned in such a manner that side 82 is adjacent to horn side 16, side 84 is adjacent to reflector 20 and side 86 is positioned adjacent to horn back 12.

Figure 8:
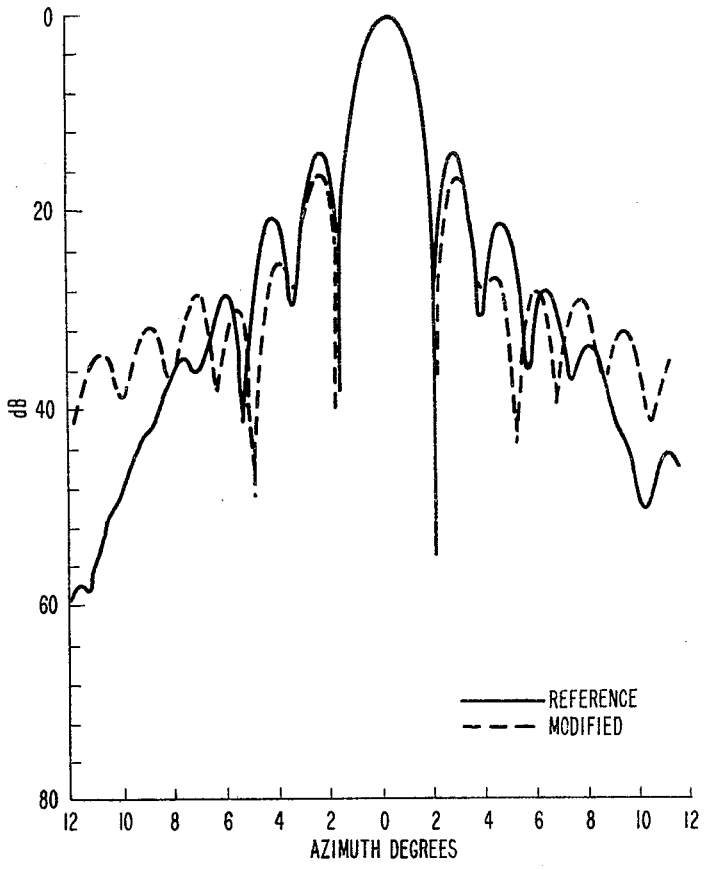
FIG. 8 illustrates the radiation patterns for a transverse polarization of the antenna configuration of FIG. 7 where the dashed curve represents the radiation pattern for the modified antenna shown in FIG. 7 and the solid curve represents the radiation pattern for the antenna without the wedges of absorbing material shown in FIG. 7.

FIG. 8 provides a comparison of the radiation patterns for a transverse polarization of the antenna configuration of FIG. 7 where the dashed curve represents the radiation pattern for the modified antenna shown in FIG. 7 comprising absorbing material 70 and 80 and the solid curve represents the radiation pattern for the antenna of FIG. 7 without absorbing material 70 and 80. From the curves shown in FIG. 8, it can be seen that by placement of absorbing material 70 and 80 the loss in gain for the main beam of the modified antenna is only approximately 0.3-dB, with no noticeable change in beam shape. There is a noticeable improvement over the radiation pattern of FIG. 6 for sidelobes beyond 8 degrees, due to the decrease in the number of absorbing material edges the wavefront encounters when wedge-shaped absorbing material 70 and 80 of FIG. 7 is used in place of absorbing material arrangements 40, 54 and 60 of FIG. 5.

It is to be understood that the above-described embodiments are simply illustrative of the principles of the invention. Various other modifications and changes may be made by those skilled in the art which will embody the principles of the invention and fall within the spirit and scope thereof.

I claim:

1. An antenna comprising:

an offset main reflector (20) including a reflecting surface and a focal point associated therewith; and absorbing material means (24, 32 in FIG. 1; 40 in FIG. 3; 41, 60 in FIG. 5; 70, 80 in FIG. 7) disposed on the reflecting surface of the main reflector capable of reducing sidelobes

CHARACTERIZED IN THAT the means capable of reducing sidelobes comprises at least one piece of absorbing material disposed only on an edge portion of a sector of the reflecting surface of the main reflector closest to the focal point of said reflector.

2. An antenna in accordance with claim 1

CHARACTERIZED IN THAT at least one piece of absorbing material is disposed asymmetrically on the edge of the reflecting surface to achieve selective sidelobe reduction.

3. An antenna in accordance with claim 1

CHARACTERIZED IN THAT at least one piece of absorbing material is disposed symmetrically on the edge of the reflecting surface closest to the focal point to achieve like reduction of sidelobes on both sides of the main beam.

4. An antenna in accordance with claims 1, 2 or 3

CHARACTERIZED IN THAT at least one piece of absorbing material includes a shape comprising at least one surface which is capable of being encountered by the wavefront impinging on the reflecting surface of the antenna, said surface directly influencing the shape of the sidelobes.

5. An antenna in accordance with claims 1, 2 or 3 where the antenna is a horn-reflector antenna comprising a rectangular horn with sides 10, 12, 14, 16 and a paraboloidal reflecting surface integrally connected to said horn

CHARACTERIZED IN THAT at least one piece of absorbing material is disposed on at least one corner formed by the integral connection of the back and at least one side of the horn and the reflecting surface to achieve sidelobe reduction.

* * * * *